United States Patent [19]

McEvers et al.

[11] 4,063,493

[45] Dec. 20, 1977

[54] ROTARY DIE CUTTING MACHINE

[75] Inventors: Dale L. McEvers; Daniel P. Struble, both of Kettering, Ohio

[73] Assignee: H&H Industries, Inc., Dayton, Ohio

[21] Appl. No.: 741,617

[22] Filed: Nov. 15, 1976

[51] Int. Cl.[2] ..... B31B 1/20

[52] U.S. Cl. ..... 93/58.2 R; 83/347; 83/561; 83/562

[58] Field of Search ..... 93/58.2 F, 58.2 R, 58 R; 83/561, 562, 347, 244, 240, 241

[56] References Cited

U.S. PATENT DOCUMENTS

| | | | |
|---|---|---|---|
| 2,776,610 | 1/1957 | Roselius | 93/58.2 R |
| 3,375,762 | 4/1968 | Sarka | 93/58.2 F |
| 3,424,043 | 1/1969 | Martin | 83/561 X |
| 3,832,926 | 9/1974 | Leaseburge et al. | 83/561 X |
| 3,882,745 | 5/1975 | Garrett et al. | 83/561 X |

FOREIGN PATENT DOCUMENTS

| | | | |
|---|---|---|---|
| 143,504 | 2/1902 | Germany | 83/244 |

*Primary Examiner*—James F. Coan
*Attorney, Agent, or Firm*—Jacox & Meckstroth

[57] ABSTRACT

A die cutting roll carries outwardly projecting die cutting blades, and a parallel back-up roll carries a resilient mat which is engaged by the blades. The rolls are driven by a set of helical gears, and the back-up roll is reciprocated axially by a set of air cylinders, so that the back-up roll moves in a helical direction when the blades are out of engagement with the mat to avoid a repeating pattern of blade engagement with the mat and thereby extend the useful service life of the mat. The sheets to be die cut are successively fed between the rolls from the bottom of a stack by a reciprocating feed member driven by oscillating arms pivotally supported by a shaft. The shaft may be rotatably adjusted on an eccentric axis while the sheets are being fed for quickly phasing the feed of the sheets relative to the rotation of the die cutting roll to obtain precise registry of each sheet with the die cutting blades.

5 Claims, 4 Drawing Figures

ROTARY DIE CUTTING MACHINE

BACKGROUND OF THE INVENTION

In the die cutting of generally flat sheets of material such as sheets of cardboard box material to produce sheets of predetermined configuration and/or for scoring the sheets to provide for folding on predetermined lines, it is desirable to use a roll-type die cutting machine, particularly when a high volume of sheets must be die cut. One form of rotary die cutting machine is disclosed in U.S. Pat. No. 3,588,095, wherein sheets are successively fed from the bottom of a stack between a set of parallel rolls one of which carries the die cutting knives or blades and the other of which carries a resilient pad or mat which is engaged by the blades on the die cutting roll.

The sheets are successively fed from the bottom of the stack by a reciprocating feed plate which forces the bottom sheet of the stack into a nip defined by a pair of parallel feed rolls disposed adjacent the die cutting and back-up rolls. All of the rolls are driven by an electric motor which also drives a crank connected by a link member to reciprocate the feed plate. The feed plate is also adjustable relative to the link member when the machine is stopped in order to adjust the leading edge of the feed plate according to the size of the sheets within the stack and to change the timing when the bottom sheet is advanced into the feed rolls to arrive at the desired registration between each sheet and the die cutting blades on the die cutting roll.

In order to prevent repetitive engagement of the die cutting blades with the resilient mat during each revolution of the rolls, a hydraulic cylinder has been used to reciprocate the back-up rolls slowly, for example, as disclosed U.S. Pat. No. 3,272,047. While such reciprocation of the back-up roll is helpful in preventing repetitive engagement of the blades on the die cutting roll with the mat during each revolution of the rolls, the reciprocation of the back-up roll does not avoid repetitive engagement of the blades on the die cutting roll with the mat at relatively close periodic intervals.

SUMMARY OF THE INVENTION

The present invention is directed to an improved rotary die cutting apparatus or machine which incorporates simplified means for substantially eliminating repetitive engagement of both the axially extending blades and the circumferentially extending or radial blades on the die cutting roll with the resilient mat on the back-up roll and thereby significantly extend the useful service life of the mat. The die cutting machine of the invention also incorporates means for adjusting the timing of the feeding of each sheet from the bottom of a supply stack into the rotary die cutting and back-up rolls while the machine is operating so that the registry of the die cutting blades on the sheets may be quickly and conveniently obtained without stopping the machine.

In accordance with one embodiment of the invention, the above features are provided by a roll drive system which includes a set of helical gears, one of which is mounted for rotation with the back-up roll. A set of air cylinders provide for reciprocating the back-up roll axially, and the maximum rate of reciprocation is controlled by a hydraulic metering cylinder. The pressure within the air cylinders is selected to avoid axial movement of the back-up roll when the die cutting blades are engaging the resilient mat on the back-up roll, and the helical drive gears cooperate to produce axial movement of the back-up roll in a helical direction for substantially eliminating repetitive engagement of the die cutting blades with the resilient mat. The drive mechanism also incorporates an oscillating arm for reciprocating the feed plate or member adjacent the bottom of the supply stack of sheets, and the pivot axis of the oscillating arm is movable about an eccentric axis while the die cutting machine is running.

Other features and advantages of the invention will be apparent from the following description, the accompanying drawing and the appended claims.

DESCRIPTION OF THE PREFERRED EMBODIMENT

Figure 1:
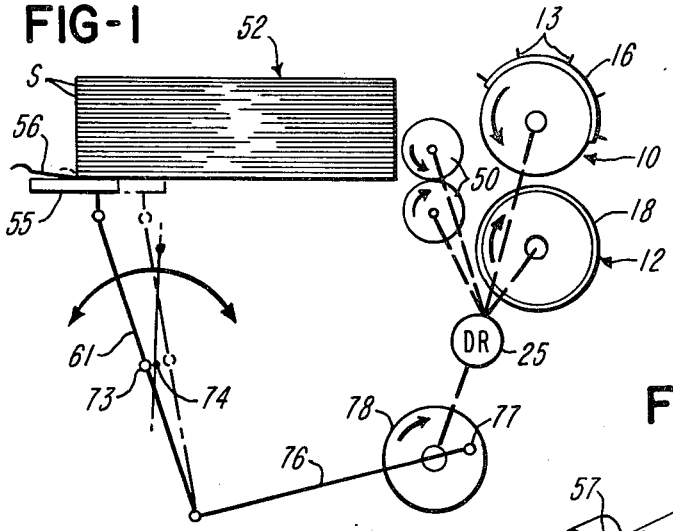
FIG. 1 is a diagrammatic elevational view of a rotary die cutting machine constructed in accordance with the invention.

Referring to the drawing which illustrates the improved rotary die cutting machine of the invention, a die cutting roll 10 has an axis disposed parallel to the axis of the an adjacent back-up roll 12 of the same diameter. The die cutting roll 10 carries outwardly projecting die cutting blades which include, for example, an axially extending blade 13 and circumferentially extending or radial blades 14. The blades 13 and 14 project into a part-cylindrical support base 16 which may be formed of wood and is secured by suitable fasteners to the roll 10. The blades 13 and 14 may be constructed for either completely cutting or shearing each sheet of material fed between the rolls 10 and 12 and/or for partially cutting or scoring each sheet.

Figure 3:
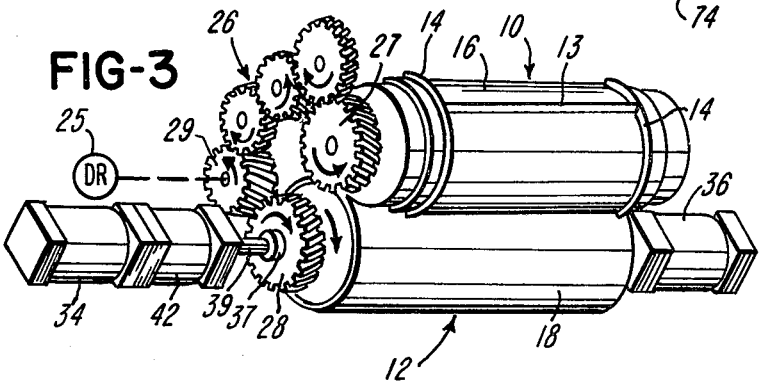
FIG. 3 is a diagrammatic perspective view of the die cutting roll and back-up roll and their drive gears, along with the means for reciprocating the back-up roll.
Figure 4:
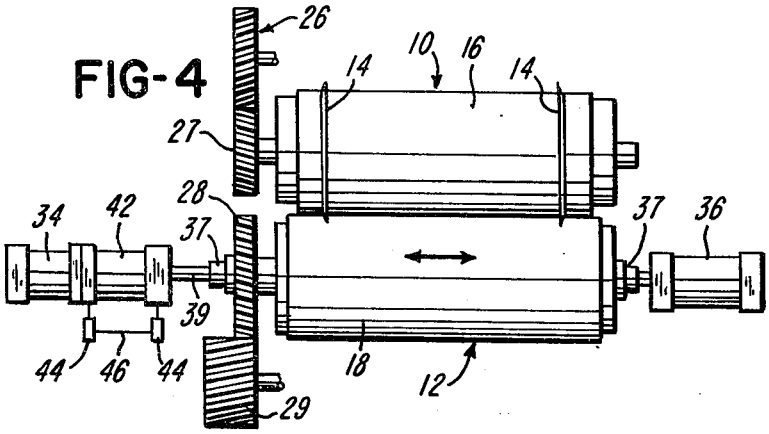
FIG. 4 is a diagrammatic elevational view of the rolls and other components shown in FIG. 3.

The back-up roll 12 carries a pad or mat 18 of resilient material such as a high density resilient foam material. The mat is engaged by the cutting edges of the blades 13 and 14 when the blades are constructed to completely sever each sheet fed between the rolls. As shown in FIGS. 3 and 4, the rolls 10 and 12 are driven by a main drive motor 25 through a set 26 of helical gears. The gear set 26 includes a gear 27 mounted for rotation with the die cutting roll 10, a gear 28 mounted for rotation with the back-up roll 12 and a main drive gear 29 which meshes with the gear 28. Preferably, the gear 27 has sixty-three teeth, and the gear 28 has 64 teeth so that during each revolution of the back-up roll 12, the die cutting roll 10 rotates through one revolution plus the pitch of one gear tooth. As also illustrated in FIGS. 3 and 4, the helical drive gear 29 has a width or an axial length substantially greater than that of the helical gear 28 so that the gear 28 may move axially while remaining in mesh with the drive gear 29.

A pair of air cylinders 34 and 36 are positioned on opposite ends of the back-up roll 12, and the piston rod of the air cylinder 36 is connected to a rotary thrust bearing 37 to apply force to the shaft for the back-up roll 12. The piston rod of the air cylinder 34 is connected to an aligned piston rod 39 of a double acting hydraulic cylinder 42, and the rod 39 is connected to another rotary bearing 37 to apply opposing force to the shaft for the back-up roll 12. Air is supplied alternately to the air cylinders 34 and 36 to produce reciprocating movement of the back-up roll 12 and its helical drive gear 28. The maximum rate of axial movement of the back-up roll 12 is adjustably controlled by a set of flow control metering valves 44 installed within a line 46 connecting opposite ends of the hydraulic cylinder 42.

Figure 2:
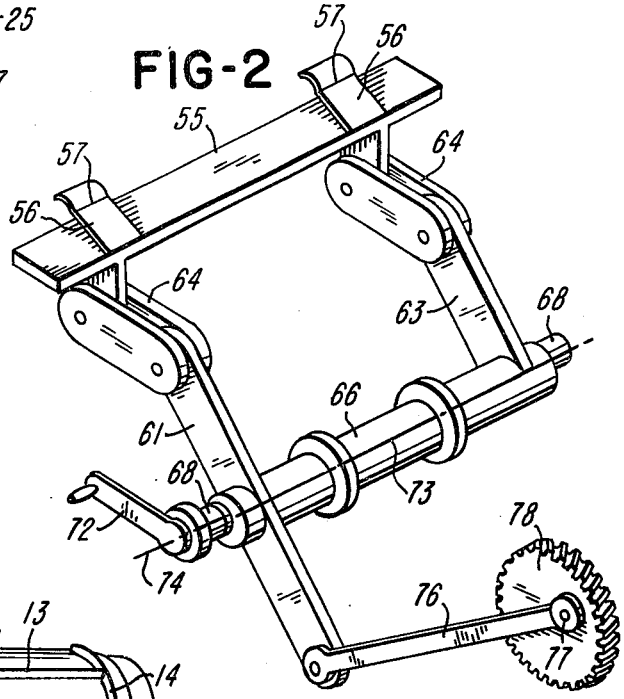
FIG. 2 is a diagrammatic perspective view of the sheet feeding mechanism shown in FIG. 1.

Referring to FIGS. 1 and 2, the drive motor 25 also drives a pair of pinch feed rolls 50 which form a nip disposed within a horizontal plane extending through the nip of the die cutting roll 10 and back-up roll 12. The speed of the feed rolls 50 is timed with the rotation of the rolls 10 and 12, and the feed rolls 50 successively feed a series of sheets S from the bottom of a stack 52. Typically, the sheets S consist of sheets of corrugated paper board or cardboard material commonly used for producing boxes, but may also be sheets of plastic or other material.

The sheets are successively advanced from the bottom of the stack 52 into the feed rolls 50 by a feed plate or member 55 which is supported for reciprocating horizontal movement adjacent the bottom of the stack 52. The feed member 55 carries a pair of leaf springs 56 which have corresponding shoulders 57 for engaging the rearward edge surface of the bottom sheet S of the stack 52. The feed member 55 is reciprocated in response to oscillation of a set of feed arms 61 and 63 which are pivotally connected to the feed member 55 by corresponding link members 64. The arms 61 and 63 are rigidly connected by a tubular sleeve 66 which is rotatably supported by a shaft having eccentrically located opposite end portions or journals 68 rotatably supported within bearings located within a frame (not shown).

A hand crank 72 is rigidly connected to one of the journals 68 to provide for moving or shifting the pivot or oscillation axis 73 of the arms 61 and 63 about the eccentric axis 74 of the rotatably supported journals 68. The lower end portion of the feed arm 61 is pivotally connected to a link member 76 which connects with a stub shaft 77 eccentrically positioned on a helical gear 78 driven by the main drive gear 29. Rotation of the gear 78 produces oscillation of the arms 61 and 63 which cause the feed member 55 to reciprocate in a horizontal plane extending through the nip of the feed rolls 50 and the nip of the die cutting and back-up rolls 10 and 12.

From the drawing and the above description, it is apparent that a rotary die cutting machine constructed in accordance with the present invention, provides desirable features and advantages. For example, by driving the rolls 10 and 12 with the helical gear set 26, the back-up roll 12 rotates circumferentially slightly relative to the die cutting roll 10 when the back-up roll 12 is shifted axially by the air cylinders 34 and 36. The pressure within the air cylinders 34 and 36 is also selected to produce axial movement of the back-up roll 12 only when the resilient mat 18 is not engaged by a die cutting blade. This form of helical movement of the back-up roll 12 cooperates with the slight differential speeds between the rolls 10 and 12 due to the difference in teeth on the gears 27 and 28, to assure that there is no regular repeating pattern of engagement of the die cutting blades 13 and 14 with the resilient mat 18 on the back-up roll 12. As a result, the service life of the mat is extended substantially, thereby significantly reducing the need for periodically replacing the resilient mat 18 to assure accurate and clean die cutting of the sheets.

As mentioned above, the support of the oscillating feed arms 61 and 63 also provide an important feature of the invention. That is, the crank 72 may be rotated through an angle of 180° while the die cutting machine is running in order to adjust the position of the reciprocating feed member 55 relative to the stack 52 of flat sheets S. This running adjustment of the feed member 55 provides for conveniently changing the timing or phasing of when each sheet is fed from the button of the stack 52 into the feed rolls 50 and relative to the rotation of the die cutting roll 10 and back-up roll 12. As a result, the die cutting blades 13 and 14 may be quickly and precisely registered with respect to the sheets so that the die cutting is performed at the desired locations on the sheets.

While the form of die cutting apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. In a rotary die cutting machine including a die cutting roll adapted to support axially extending and circumferentially extending die cutting blades, a back-up roll having an axis disposed substantially parallel to the axis of said die cutting roll, a mat of resilient material mounted on said back-up roll and adapted to be engaged by said die cutting blades when the rolls are rotated, means for successively feeding sheets of material to be die cut between said rolls, means for driving said rolls and said sheet feeding means, and means for reciprocating said back-up roll in an axial direction, the improvement wherein said means for reciprocating said back-up roll comprises air cylinder means connected to move said back-up roll axially, means for supplying air pressure to said air cylinder means, a hydraulic cylinder having an axially movable member connected to move axially with said back-up roll, means for metering the flow of hydraulic fluid within said hydraulic cylinder to control the maximum rate of axial reciprocating movement of said back-up roll by said air cylinder means, and means for simultaneously rotating said back-up roll relative to said die cutting roll when said back-up roll moves axially to avoid repetitive engagement of said die cutting blades with said mat.

2. A die cutting machine as defined in claim 1 wherein said means for successively feeding sheet material between said rolls, comprise a feed member adapted to engage an edge surface of each sheet, said drive means include a drive mechanism connected to reciprocate said feed member in a direction generally perpendicular to a plane defined by the axes of said rolls, said drive mechanism includes arm means suppported for oscillatory movement on a pivot axis, shaft means supporting said arm meams for oscillation on said pivot axis, and means for rotating said shaft means on an axis eccentric to said pivot axis for ajusting the position of said feed member relative to said rolls while said drive mechanism is operating and said rolls are rotating for quickly and precisely adjusting the feed of each sheet relative to the rotation of said cutting blades with said die cutting roll.

3. A die cutting machine as defined in claim 1 wherein said air cylinder means comprise a set of opposing air cylinders disposed at opposite ends of said back-up roll.

4. In a rotary die cutting machine including a die cutting roll adapted to support axially extending and circumferentially extending die cutting blades, a back-up roll having an axis disposed substantially parallel to the axis of said die cutting roll, a mat of resilient material mounted on said back-up roll and adapted to be engaged by said die cutting blades when the rolls are rotated, means for successively feeding sheets of material to be cut between said rolls and including a feed member supported for reciprocating movement in a direction generally perpendicular to a plane defined by the axes of said rolls, and means for driving said rolls and for reciprocating said feed member, the improvement wherein said driving means comprise a mechanism including arm means supported for oscillatory movement on a pivot axis, shaft means supporting said arm means for oscillation on said pivot axis, and means for rotating said shaft means on an axis eccentric to said pivot axis for adjusting the position of said pivot axis while said feed member is reciprocating and said rolls are rotating for quickly and precisely adjusting the feed of each sheet relative to the rotation of said die cutting blades with said die cutting roll.

5. A die cutting machine as defined in claim 4 wherein said arm means comprises at least one generally vertical arm, a pivotal link member connecting the upper portion of said arm to said feed member, said driving means include a rotary crank member pivotally connected to the lower portion of said arm, and an intermediate portion of said arm is supported by said shaft means.

* * * * *